US009028744B2

(12) United States Patent
Durocher et al.

(10) Patent No.: US 9,028,744 B2
(45) Date of Patent: May 12, 2015

(54) MANUFACTURING OF TURBINE SHROUD SEGMENT WITH INTERNAL COOLING PASSAGES

(75) Inventors: Eric Durocher, Vercheres (CA); Guy Lefebvre, Saint-Bruno (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 383 days.

(21) Appl. No.: 13/222,007

(22) Filed: Aug. 31, 2011

(65) Prior Publication Data

US 2013/0052074 A1 Feb. 28, 2013

(51) Int. Cl.

| | |
|---|---|
| ***B22F 3/22*** | (2006.01) |
| ***B22F 5/00*** | (2006.01) |
| ***F01D 9/04*** | (2006.01) |
| *F01D 11/24* | (2006.01) |

(52) U.S. Cl.

CPC ..... *B22F 3/225* (2013.01); *B22F 5/009* (2013.01); *F01D 9/04* (2013.01); *F01D 11/24* (2013.01); *F05D 2230/21* (2013.01); *F05D 2230/22* (2013.01); *F05D 2240/11* (2013.01)

(58) Field of Classification Search

USPC ..... 264/635; 419/5

See application file for complete search history.

(56) References Cited

U.S. PATENT DOCUMENTS

| | | | | |
|---|---|---|---|---|
| 3,831,258 | A | 8/1974 | Elbert et al. | |
| 4,137,619 | A | 2/1979 | Beltran et al. | |
| 4,383,854 | A | 5/1983 | Dembowski et al. | |
| 4,604,780 | A | 8/1986 | Metcalfe | |
| 4,871,621 | A | 10/1989 | Bagley et al. | |
| 5,010,050 | A | 4/1991 | Wullenweber et al. | |
| 5,130,084 | A | 7/1992 | Matheny et al. | |
| 5,553,999 | A | 9/1996 | Proctor et al. | |
| 5,574,957 | A | 11/1996 | Barnard et al. | |
| 5,772,748 | A | 6/1998 | Hubbard | |
| 5,933,699 | A | 8/1999 | Ritter et al. | |
| 5,950,063 | A | 9/1999 | Hens et al. | |
| 6,102,656 | A | 8/2000 | Nissley et al. | |
| 6,217,282 | B1 | 4/2001 | Stanka | |
| 6,350,404 | B1 * | 2/2002 | Li et al. | 264/635 |
| 6,679,680 | B2 | 1/2004 | Um et al. | |
| 6,709,771 | B2 | 3/2004 | Allister | |
| 6,857,848 | B2 | 2/2005 | Fokine et al. | |
| 6,874,562 | B2 | 4/2005 | Knott et al. | |
| 6,910,854 | B2 | 6/2005 | Joslin | |
| 7,029,228 | B2 | 4/2006 | Chan et al. | |
| 7,052,241 | B2 | 5/2006 | Decker | |
| 7,114,920 | B2 | 10/2006 | Synnott | |
| 7,128,522 | B2 | 10/2006 | Jutras | |
| 7,175,387 | B2 | 2/2007 | Kreis et al. | |
| 7,217,081 | B2 | 5/2007 | Scheurlen et al. | |
| 7,234,920 | B2 | 6/2007 | Imbourg et al. | |
| 7,407,622 | B2 | 8/2008 | Voice et al. | |
| 7,687,021 | B2 | 3/2010 | Imbourg et al. | |
| 7,857,581 | B2 | 12/2010 | Mons et al. | |
| 7,875,340 | B2 | 1/2011 | Cho et al. | |
| 2005/0214156 | A1 | 9/2005 | Troitski et al. | |
| 2011/0033331 | A1 | 2/2011 | Tuppen et al. | |
| 2012/0186768 | A1 * | 7/2012 | Sun et al. | 164/23 |

* cited by examiner

*Primary Examiner* — Weiping Zhu

(74) *Attorney, Agent, or Firm* — Norton Rose Fulbright Canada LLP

(57) ABSTRACT

A turbine shroud segment is metal injection molded (MIM) about a low melting point material insert. The low melting point material is dissolved using heat during the heat treatment cycle required for the MIM material, thereby leaving internal cooling passages in the MIM shroud segment without extra manufacturing operation.

13 Claims, 5 Drawing Sheets

MANUFACTURING OF TURBINE SHROUD SEGMENT WITH INTERNAL COOLING PASSAGES

TECHNICAL FIELD

The application relates generally to the field of gas turbine engines, and more particularly, to a method for manufacturing turbine shroud segments with internal cooling passages.

BACKGROUND OF THE ART

Conventional molten metal casting methods used to produce shroud segments require that the casting core used to form internal cooling passages inside the shroud segment be made out of refractory or high temperature resistance materials, such as ceramic, in order not to be damaged or destroyed when the molten casting material is poured into the mold to form the shroud segment. There are a series of disadvantages (cost, fragile, extraction after cast) and limitations (shape and size) associated to the use of ceramic cores and the like. Indeed, ceramic cores are relatively costly to produce and fragile. Several operations, such as chemical leaching, may be required to dissolve the ceramic insert and clean the internal cooling cavity left by the dissolved ceramic insert in the cast turbine shroud segment, resulting in additional manufacturing costs. The use of ceramic also imposes some restrictions to the designers in terms of shape and size of the casting core.

There is thus a need for a new shroud segment manufacturing method.

SUMMARY

In one aspect, there is provided a method of manufacturing a turbine shroud segment with internal cooling passages, the method comprising: forming an insert from a low melting point material, the insert having a configuration corresponding to that of the internal cooling passages to be formed in the turbine shroud segment; positioning the insert in a metal injection mold defining a mold cavity having a configuration corresponding to the configuration of the turbine shroud segment to be produced; metal injection molding (MIM) a shroud body about the insert, including injecting a base metal powder mixture into the mold at a temperature inferior to a melting temperature of the insert; and sintering the shroud body at a sintering temperature superior to the melting temperature of the insert, thereby causing the dissolution of the insert and the consolidation of the MIM shroud body.

In a second aspect, there is provided a method of manufacturing a shroud segment for a gas turbine engine, the method comprising: forming a plastic insert; metal injection molding (MIM) a shroud segment body about the insert, and subjecting the MIM shroud segment body to a heat treatment to dissolve the plastic insert and sinter the MIM shroud body.

DESCRIPTION OF THE DRAWINGS

Reference is now made to the accompanying figures, in which.

DETAILED DESCRIPTION

Figure 1:
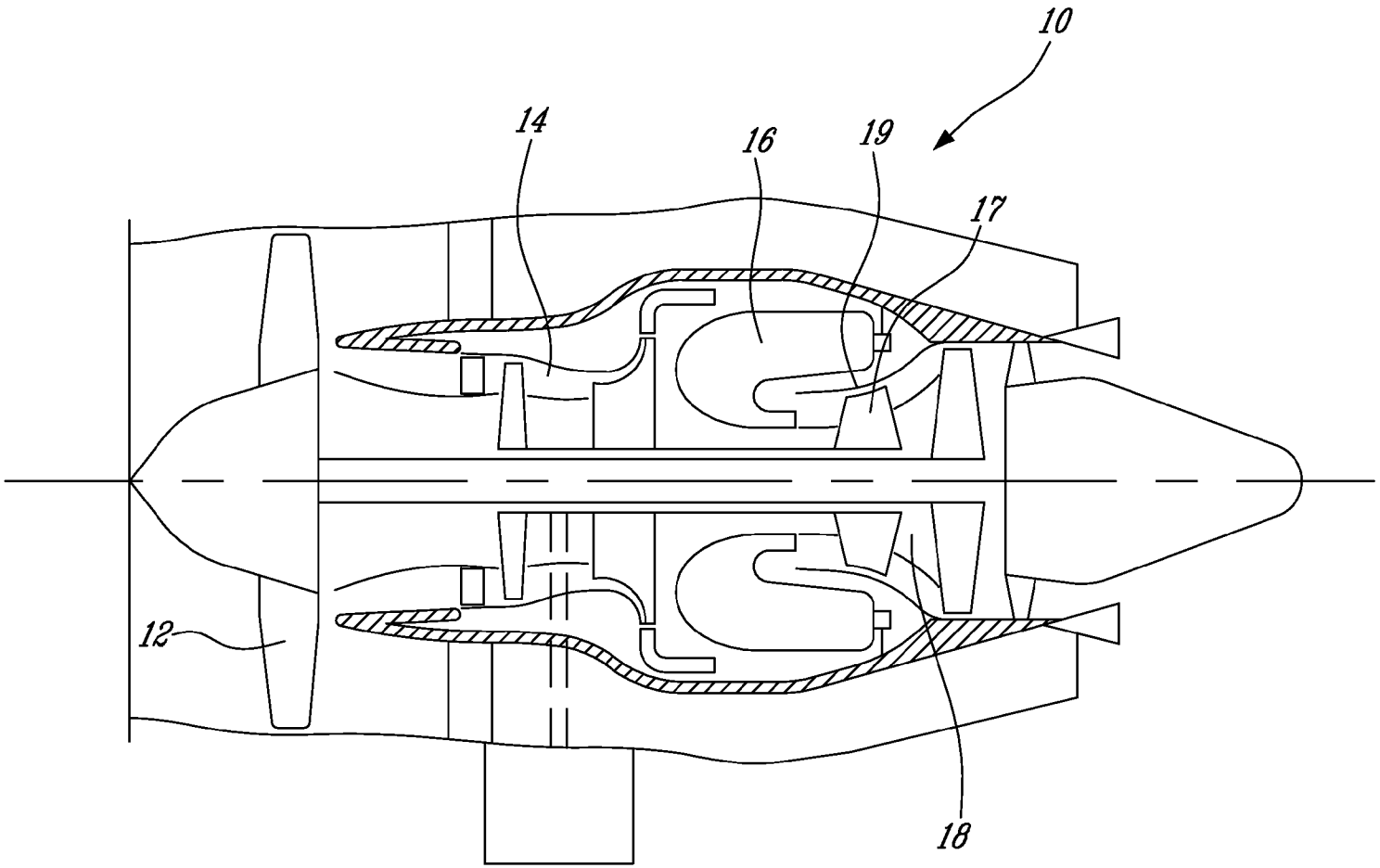
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2A:
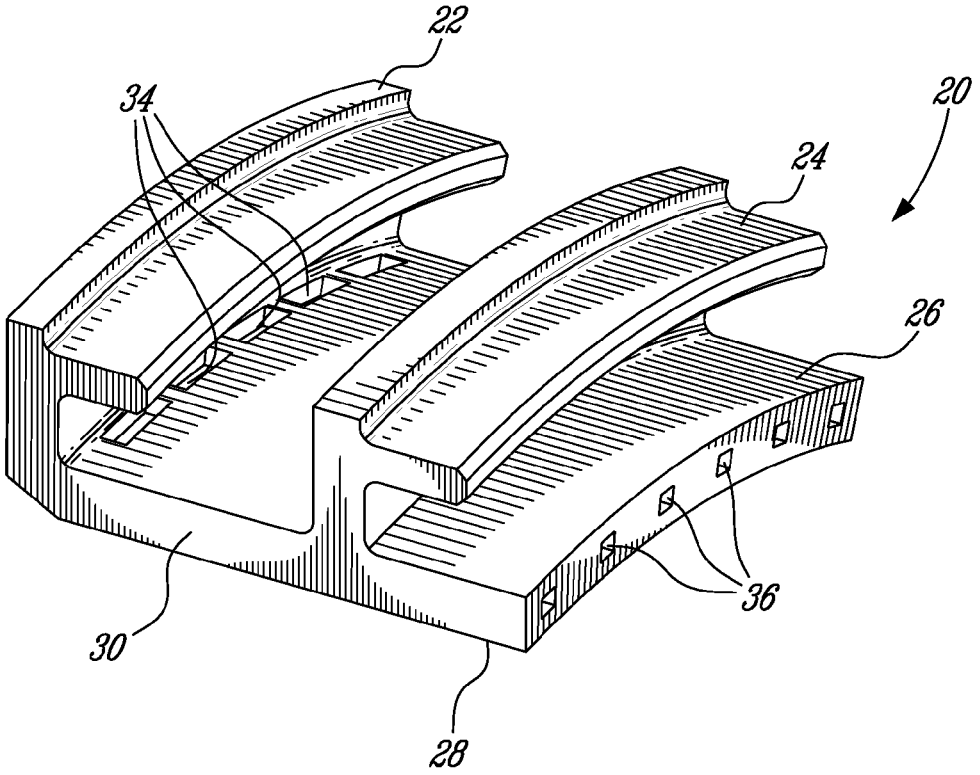
FIG. 2*a* is an isometric view of a metal injection molded (MIM) turbine shroud segment having internal cooling passages.
Figure 2B:
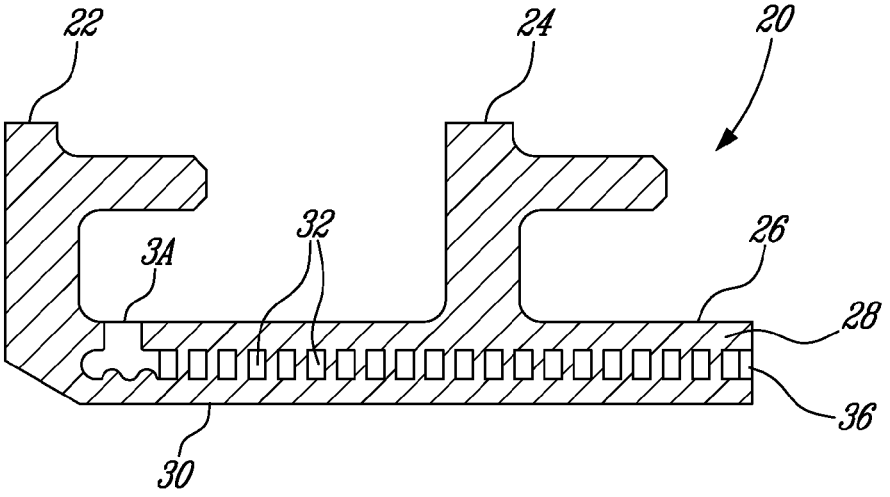
FIG. 2*b* is a cross-section view of the MIM turbine shroud segment shown in FIG. 2*b;*

The turbine section 18 generally comprises one or more stages of rotor blades 17 extending radially outwardly from respective rotor disks, with the blade tips being disposed closely adjacent to an annular turbine shroud 19 supported from the engine casing. The turbine shroud 19 is typically circumferentially segmented. FIGS. 2*a* and 2*b* illustrate an example of one such turbine shroud segments 20. The shroud segment 20 comprises axially spaced-apart forward and aft hooks 22 and 24 extending radially outwardly from a cold radially outer surface 26 of an arcuate platform 28. The platform 28 has an opposite radially inner hot gas flow surface 30 adapted to be disposed adjacent to the tip of the turbine blades. Internal cooling passages 32 are defined in the platform 28. The internal cooling passages 32 extend between inlets 34 and outlets 36 respectively defined in the radially outer surface 26 and the trailing edge of the shroud segment 20. The internal cooling scheme shown in FIGS. 2*a* and 2*b* is for illustration purposes only. It is understood that both the configuration of the shroud segment 20 and the cooling scheme could adopt a wide variety of configurations.

As will be described hereinafter, the turbine shroud segment 20 with its internal cooling passages 32 may be formed by metal injection molding (MIM) the shroud body about a sacrificial insert having a configuration corresponding to that of the internal cooling passages 32. By metal injection molding the shroud segment instead of casting it, it becomes possible to use a wider variety of materials to form the sacrificial insert. The MIM process is conducted at temperatures which are significantly lower than molten metal temperatures associated to conventional casting processes. Accordingly, the insert no longer has to be made out of a refractory material, such as ceramic. With the MIM process, the designer can selected insert materials that provides added flexibility in use and that are subsequently easier to remove from the shroud segment body by simple heat treatment operations or the like. An example of an insert 38 that could be used to create the internal cooling passages 32 is shown in FIG. 3.

The insert 38 may be molded or otherwise made out of a low melting point material. The expression "low melting point material" is herein used to generally encompass any material that remains chemically and physically stable at temperatures corresponding to the injection temperatures of the MIM material but that will melt down (vaporize) during the consolidation heat treatment cycle of the MIM part. For instance, the insert 38 could be made out of plastic. Other suitable materials could include: any type of plastics, wax (that has higher melting point than binder used in the MIM material) or Tin/Bismuth based alloy. This is not intended to constitute an exhaustive list.

Figure 3:
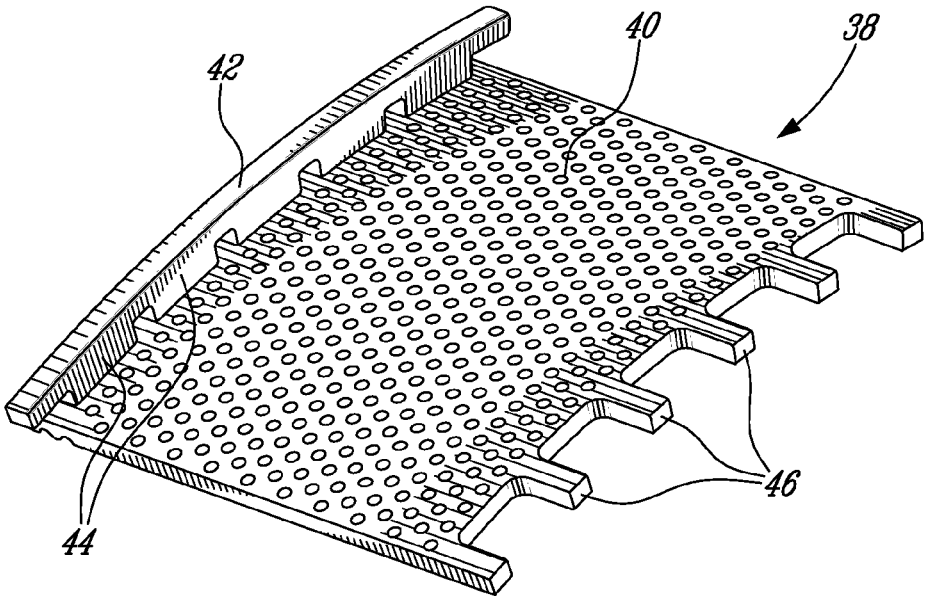
FIG. 3 is a schematic isometric view of a plastic insert used to create the internal cooling passages of the turbine shroud segment shown in FIG. 2.

As shown in FIG. 3, the insert 38 may be provided in the form of a solid part.

In the illustrated embodiment, the insert 38 is a one-piece molded plastic part having a perforated panel-like section 40 and a rib or bridge-like structure 42 extending along a first side edge of the panel-like section 40. Spaced-apart pillars 44 extend integrally upwardly from the top surface of the panel-like section 40 to support the bridge-like structure 42 thereon. Fingers 46 are integrally formed in a second side edge of the panel-like section 40 opposite to the first side edge thereof. The bridge-like structure 42 and the associated pillars 44 are used to create the inlets 34 in the final product. Likewise, the fingers 46 are used to form the outlets 36 in the final product. The perforated panel-like section 40 is used to define the cooling passages 32 between the inlets 34 and outlets 36 in the final product. As mentioned hereinabove, it is understood that the insert 38 may adopt various configurations depending of the desired internal cooling passage configuration.

Figure 4:
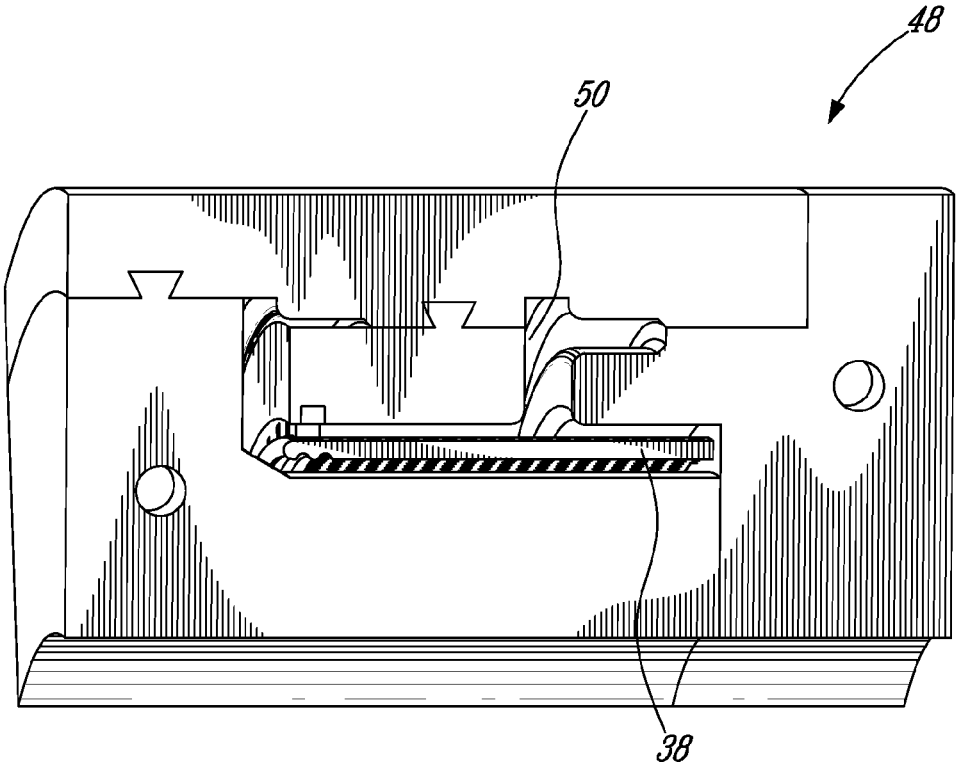
FIG. 4 is a schematic end view illustrating the positioning of the insert in a metal injection mold.

As shown in FIG. 4, the insert 38 is positioned in a metal injection mold 48 including a plurality of mold details (only some of which are schematically shown in FIG. 4) that can be assembled to jointly formed a closed mold cavity 50 having a configuration corresponding to that of the turbine shroud segment to be produced. The mold cavity 50 typically is larger than that of the desired finished part to account for the shrinkage that occurs during debinding and sintering of the green shroud segment. Pins (not shown) or the like may be used to support the insert 38 in the mold 48. The pins could be used at the same time to create cooling holes in the shroud body.

After the insert 38 has been properly positioned in the mold 48, the assembly of the mold 48 is completed and the mold cavity 50 is filled with a base metal powder mixture, otherwise known as a MIM feedstock. The MIM feedstock generally comprises a binder and a metal powder. A variety of binder may be used, such as waxes, polyolefins such as polyethylenes and polypropylenes, polystyrenes, polyvinyl chloride etc. This is not intended to constitute an exhaustive list. The metal powder can be selected among a wide variety of metal powders, including, but not limited to Nickel alloys. A suitable mixture will provide enough "fluidity" by playing with viscosity of the mixture in order to carry feedstock in each cavities of the mold.

Figure 5:
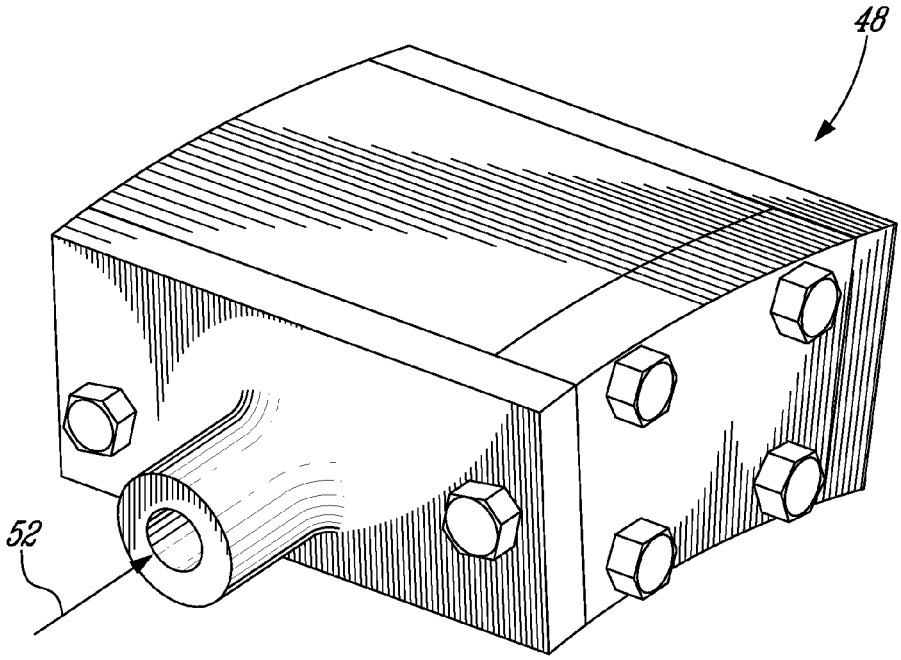
FIG. 5 is a schematic isometric view of the metal injection mold ready to receive MIM feedstock to form the MIM shroud segment about the insert.

As depicted by arrow 52 in FIG. 5, the MIM feedstock is injected in the mold 48. The MIM feedstock is injected at a low temperature (e.g. at temperatures equal or inferior to 250 degrees Fahrenheit (121 deg. Celsius)) and at a low pressure (e.g. at pressures equal or inferior to 100 psi (689 kPa)). The injection temperature is selected to be inferior to the melting point of the material selected to form the insert 38. Injecting the feedstock at temperatures higher than the melting point of the insert material would obviously damage the insert 38 and result in improperly molded shroud segments. The feedstock is thus injected at a temperature at which the insert 38 will remain chemically and physically stable. It is understood that the injection temperature is function of the composition of the feedstock. Typically, the feedstock is heated to temperatures in a temperature zone closed to the binding material melting point. Accordingly, the artisan will choose the composition of the feedstock to have the right injection temperature relative to the melting point of the insert material and vice versa. The injection pressure is also selected so as to not compromise the integrity of the insert 38. In other words, the insert 38 must be designed to sustain the pressures typically involved in a MIM process. If the temperatures or the pressures were to be too high, the integrity of the insert could be compromised leading to defects in the final products.

Figure 6:
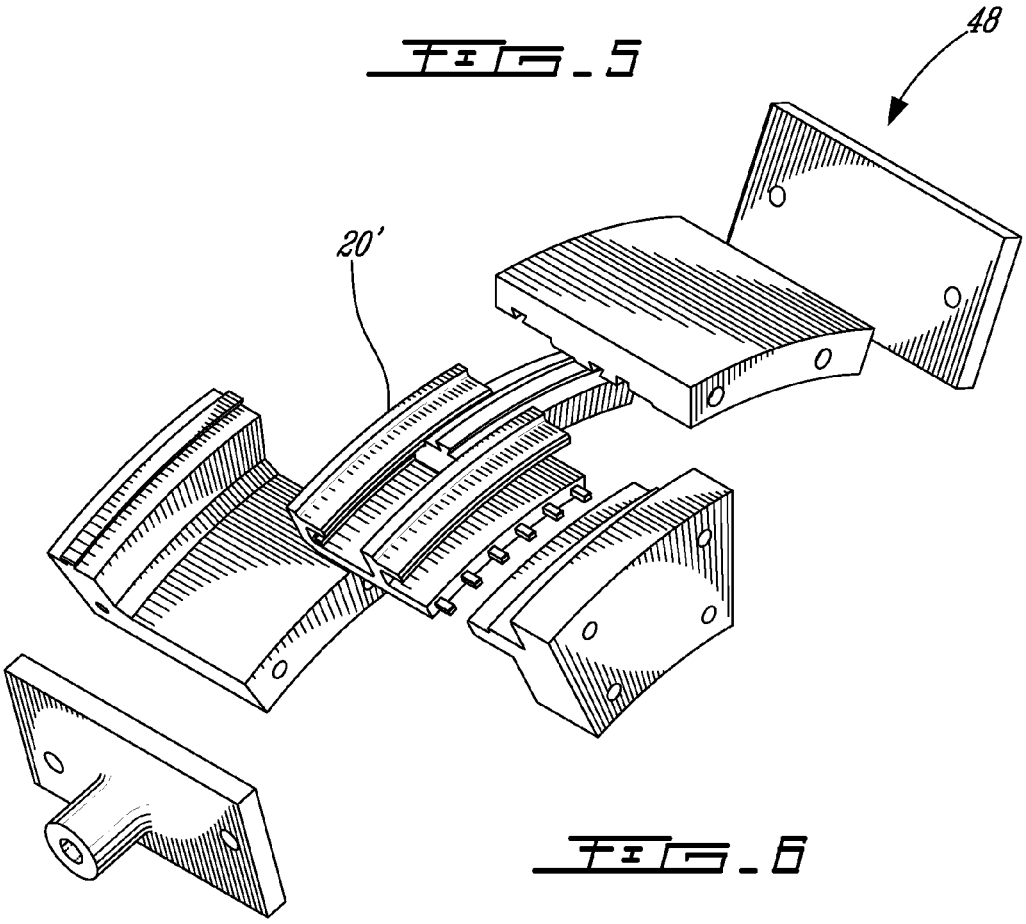
FIG. 6 is a schematic view illustrating how the mold details are disassembled to liberate the shroud segment with the integrated/imbedded insert.

Once the feedstock is injected into the mold 48, it is allowed to solidify in the mold 48 to form a green compact around the insert 38. After it has cooled down and solidified, the mold details are disassembled and the green shroud segment 20' with its embedded insert 38 is removed from the mold 48, as shown in FIG. 6. The term "green" is used herein to refer to the state of a formed body made of sinterable powder or particulate material that has not yet been heat treated to the sintered state.

Figure 7:
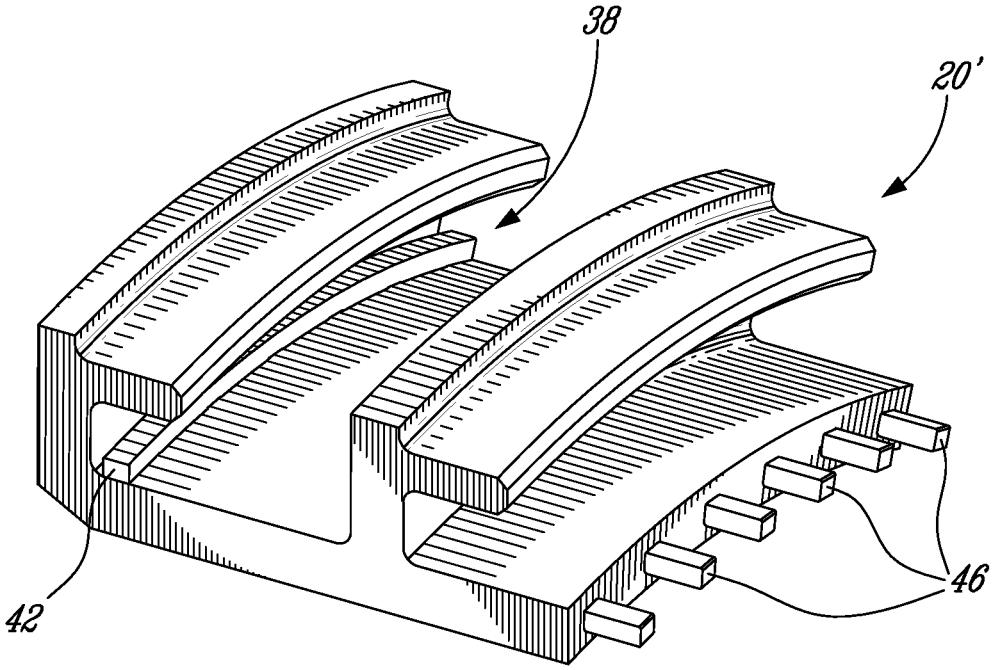
FIG. 7 is a schematic isometric view of a de-molded "green" MIM shroud segment before the insert be dissolved to form the internal cooling passages.

FIG. 7 illustrates the demolded green shroud segment 20' with the insert 38 still imbedded inside the MIM shroud body. Conditioning operations, including debinding and sintering, are then performed on this green shroud segment 20' to remove the binder material and to consolidate the molded metal shroud segment into a dense metal part having mechanical properties similar to the material in casted or wrought form. At least some of the conditioning operation (e.g. sintering) are performed at high temperatures which are well beyond the melting point of the insert, thereby causing the insert to be concurently dissolved or vaporized during the heat treatment cycle of the MIM shroud segment and that without requiring any extra manufacturing operations. The use of a low melting point material insert in combination with a MIM process eliminate the need for a separate insert removal operation. The melting temperature of materials, such as plastic, are indeed well below the sintering temperatures of metal powders and, thus, plastic inserts and the like may be completely dissolved/vaporized without performing any dedicated insert removal operations. The sintering temperature of various metal powders is well-known in the art and can be easily determined by an artisan familiar with powder metallurgy.

Next, the resulting sintered shroud segment body may be subjected to any appropriate metal conditioning or finishing treatments, such as grinding and/or coating to obtain the final product shown in FIG. 2.

The above described shroud manufacturing method has several advantages including design flexibility, simplified production process, manufacturing lead-time reduction, production cost savings, no need for hazardous materials to dissolve casting ceramic cores, etc. Plastic materials and the like can be easily put into shape and are less fragile than ceramics. Plastic materials have thus less design limitations in term of shape and size when compared to ceramics. More complex internal cooling schemes can thus be realized.

The above description is meant to be exemplary only, and one skilled in the art will recognize that changes may be made to the embodiments described without departing from the scope of the invention disclosed. For example, it is understood that the combination of materials used for the insert and the shroud segment could vary. Still other modifications which fall within the scope of the present invention will be apparent to those skilled in the art, in light of a review of this disclosure, and such modifications are intended to fall within the appended claims.

The invention claimed is:

1. A method of manufacturing a turbine shroud segment with internal cooling passages, the method comprising:

forming an insert from a low melting point material, the insert having a one-piece body and a configuration corresponding to that of the internal cooling passages to be formed in the turbine shroud segment, the one-piece body having a perforated panel section defining a network of channels and at least a first projection and a second projection extending from the perforated panel section for respectively forming inlet and outlet passages in the turbine shroud segment;

positioning the insert in a metal injection mold defining a mold cavity having a configuration corresponding to the configuration of the turbine shroud segment to be produced;

metal injection molding (MIM) a shroud body about the insert, including injecting a base metal powder mixture into the mold at a temperature inferior to a melting temperature of the insert and forming a shroud green body; and applying a heating treatment to the shroud green body and the insert, the heating treatment including sintering the shroud green body at a sintering temperature superior to the melting temperature of the insert so as to form the shroud body and concurrently dissolving the insert.

2. The method defined in claim 1, comprising making the insert from plastic material.

3. The method defined in claim 1, wherein the base metal powder mixture is injected at a temperature of not more than about 250 deg. Fahrenheit.

4. The method defined in claim 1, wherein the base metal powder mixture is injected at a pressure of not more than about 100 psi.

5. The method defined in claim 1, wherein the insert is made out of plastic and the base metal powder mixture is injected at a temperature inferior to about 250 deg. Fahrenheit and at a pressure inferior to about 100 psi.

6. The method defined in claim 1, wherein the low temperature melting material is selected from a group consisting of: plastic material, wax and Tin/Bismuth alloy.

7. The method defined in claim 1, wherein forming an insert comprises making a solid body from plastic material.

8. A method of manufacturing a shroud segment for a gas turbine engine, the method comprising: forming a plastic insert the plastic insert having a perforated panel section defining a network of channels and at least first and second projections extending from the perforated panel section to form inlet and outlet passages in the shroud segment respectively; metal injection molding (MIM) a shroud segment body about the insert, and subjecting the MIM shroud segment body to a heat treatment to dissolve the plastic insert and sinter the MIM shroud body.

9. The method defined in claim 8, wherein forming a plastic insert comprises molding a solid plastic part having a configuration corresponding to a desired configuration of an internal cooling scheme of the shroud segment.

10. The method defined in claim 8, wherein the plastic insert has a melting temperature which is superior to an injection temperature of the MIM material used to form the shroud body, and wherein the melting temperature of the plastic insert is inferior to a sintering temperature of the MIM material.

11. The method defined in claim 10, wherein the MIM material is injected at a temperature of not more than about 250 deg. Fahrenheit.

12. The method defined in claim 10, wherein the MIM material is injected at a pressure of not more than about 100 psi.

13. The method defined in claim 8, comprising using pins to hold the plastic insert in an injection mold defining a mold cavity having a configuration corresponding to that of the shroud segment to be produced, and wherein the pins also are used to create cooling holes in the MIM shroud segment body.

* * * * *